US011559872B2

(12) United States Patent
Tazibt et al.

(10) Patent No.: US 11,559,872 B2
(45) Date of Patent: Jan. 24, 2023

(54) DEVICE AND METHOD FOR THE SURFACE TREATMENT OF A MATERIAL

(71) Applicant: CRITT TECHNIQUES JET FLUIDE ET USINAGE, Bar-le-Duc (FR)

(72) Inventors: Abou-El-Foutouh Tazibt, Bettancourt-la-Ferrée (FR); Jennifer Ascani, Sivry-Ante (FR)

(73) Assignee: CRITT TECHNIQUES JET FLUIDE ET USINAGE, Bar-le-Duc (FR)

( * ) Notice: Subject to any disclaimer, the term of this patent is extended or adjusted under 35 U.S.C. 154(b) by 0 days.

(21) Appl. No.: 17/052,620

(22) PCT Filed: May 3, 2019

(86) PCT No.: PCT/EP2019/061437
§ 371 (c)(1),
(2) Date: Nov. 3, 2020

(87) PCT Pub. No.: WO2019/211462
PCT Pub. Date: Nov. 7, 2019

(65) Prior Publication Data

US 2021/0178552 A1 Jun. 17, 2021

(30) Foreign Application Priority Data

May 4, 2018 (FR) ..... 1853853

(51) Int. Cl.
*B24C 1/00* (2006.01)
*B24C 5/04* (2006.01)

(52) U.S. Cl.
CPC ..... *B24C 1/003* (2013.01); *B24C 5/04* (2013.01)

(58) Field of Classification Search
CPC ..... B24C 1/003; B24C 5/04
See application file for complete search history.

(56) References Cited

U.S. PATENT DOCUMENTS 5,509,849 A 4/1996 Spears, Jr.
5,733,174 A 3/1998 Bingham et al.
(Continued)

FOREIGN PATENT DOCUMENTS

CH 711659 A2 4/2017
DE 20315998 U1 1/2004
(Continued)

OTHER PUBLICATIONS

International Search Report and Written Opinion dated Jul. 4, 2019 in corresponding application No. PCT/EP2019/061437; w/ English partial translation and partial machine translation (total 20 pages).
(Continued)

*Primary Examiner* — Erin F Bergner
(74) *Attorney, Agent, or Firm* — Seckel IP, PLLC

(57) ABSTRACT

A device and a method for the surface treatment of a material by a pressurized jet of liquid nitrogen, supercritical cryogenic nitrogen or hypercritical cryogenic nitrogen that may be loaded with particles, use a device that includes a mixing chamber (10) closed by a downstream wall with an outlet orifice, and a diffusion focusing barrel (20) having an inlet and an outlet, the inlet being designed to be fastened to the mixing chamber (10) while being in fluid contact with the outlet orifice of the mixing chamber (10), the pressurized jet of nitrogen having to pass through the focusing barrel from the inlet to the outlet. The diffusion focusing barrel (20) includes a hollow tube having three successive portions placed one after the other, namely a convergent portion (21) located on the side of the inlet opening of the diffusion focusing barrel and whose inner face, considered in the direction of flow of the nitrogen jet, is convergent, a neck (22) whose inner face is cylindrical, and a divergent portion (23) ending in the outlet of the diffusion focusing barrel and
(Continued)

Figure 1B:
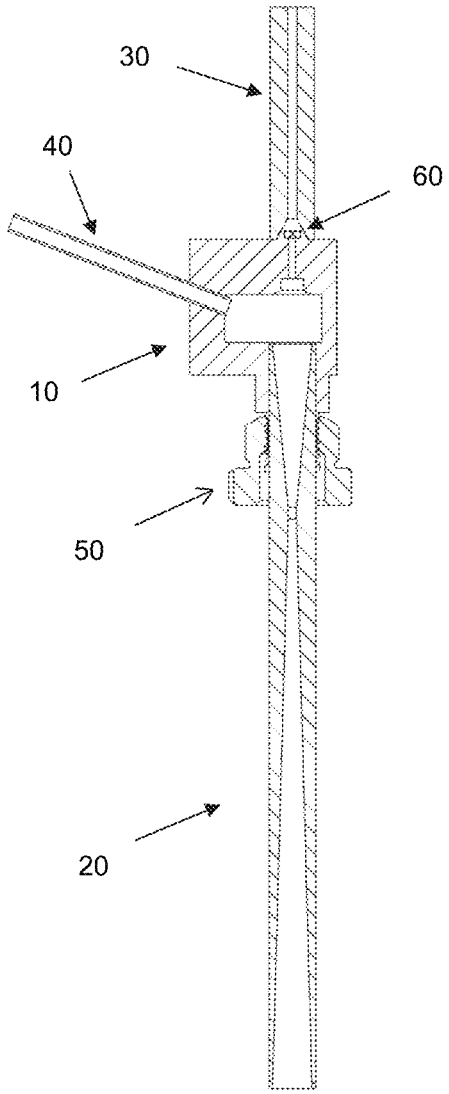

whose inner face, considered in the direction of flow of the nitrogen jet, is divergent.

21 Claims, 4 Drawing Sheets

(56) References Cited

U.S. PATENT DOCUMENTS

| | | | |
|---|---|---|---|
| 2006/0011734 | A1 | 1/2006 | Kipp |
| 2006/0049274 | A1 | 3/2006 | Hume et al. |
| 2006/0053165 | A1* | 3/2006 | Hume ..... B24C 3/04 |
| 2006/0275554 | A1 | 12/2006 | Zhao et al. |
| 2008/0092558 | A1 | 4/2008 | Hume et al. |
| 2008/0092923 | A1 | 4/2008 | Elbing et al. |
| 2012/0137846 | A1 | 6/2012 | Quintard et al. |
| 2014/0131484 | A1 | 5/2014 | Gomez et al. |

FOREIGN PATENT DOCUMENTS

| | | | |
|---|---|---|---|
| DE | 102005005638 | B3 | 2/2006 |
| JP | S63156661 | A | 6/1988 |
| JP | 2008529760 | A | 8/2008 |
| JP | 2011218324 | A | 11/2011 |
| WO | 2011004085 | A1 | 1/2011 |
| WO | 2013001205 | A1 | 1/2013 |

OTHER PUBLICATIONS

Japanese Office Action dated Nov. 29, 2022 in corresponding application No. JP2021-510542; w/ English machine translation (total 14 pages).

* cited by examiner

DEVICE AND METHOD FOR THE SURFACE TREATMENT OF A MATERIAL

The invention relates to a device for the surface treatment of a material by a pressurized jet of liquid nitrogen, supercritical cryogenic nitrogen or hypercritical cryogenic nitrogen that may be loaded with particles. The device comprises a mixing chamber closed by a downstream wall in which an outlet orifice is made, as well as a focusing barrel having an inlet opening and an outlet opening and serving as an outlet line. The inlet opening of the barrel is designed to be fastened to the mixing chamber so as to be in fluid contact with the outlet orifice of the mixing chamber, the pressurized jet of liquid nitrogen, supercritical cryogenic nitrogen or hypercritical cryogenic nitrogen having to pass through the focusing barrel from the inlet opening to the outlet opening. The invention also relates to a method for the surface treatment of a material by a pressurized jet of liquid nitrogen, supercritical cryogenic nitrogen or hypercritical cryogenic nitrogen that may be loaded with particles, in particular by using the device of the invention, for example for stripping, texturing, cleaning, structuring and surface preparation of a part.

Various methods are known for the surface treatment of a material, in particular for stripping it.

Sandblasting or shot blasting uses the projection by compressed air at very low pressure (between 5 and 20 bars) of abrasive particles of sand (sandblasting), ceramics (for example corundum) or metal shot (shot blasting) using a tool called "pistol". Abrasives are added to the compressed air stream in the mixing chamber located in the blasting pistol using a Venturi effect created by the speed of the air. The particle-air mixture is then accelerated by the expansion of the air which occurs in a conduit called a "nozzle", whose geometric shape varies according to the applications. The projection nozzles can have a circular or rectangular transverse cross-section and their length is variable. It can reach 300 mm for certain applications.

Sandblasting or shot blasting is used in particular for stripping paints or rust, or for preparing a surface before depositing a coating or paint. It allows working using the dry method and its erosive power is very interesting for deposits with low metallurgical or chemical adhesion strength, such as paints or oxides not diffused in the substrates. Large areas can be treated and sandblasting or shot blasting machines can be easily transported to work sites.

The disadvantage of this method resides in particular in the fact that it produces a large volume of toxic waste which must then be treated or stored. In addition, the dust generated by abrasive projections makes it difficult to work in this environment. Moreover, this technique is inoperative for highly adherent deposits (strong metallurgical or chemical adhesion) such as oxides formed by diffusion of oxygen in titanium-based materials, for example. In addition, it cannot be automated and it presents risks for the operator, hence the obligation for the latter to wear personal protective equipment.

Chemical techniques are also known that use acids or solvents to remove layers of paints or oxides, including hard oxides diffused into metal substrates. When it concerns the stripping of very resistant oxides diffused in the substrates, such as $TiO_2$ (alpha-case) diffused in titanium or titanium alloys, such as TA6V (Ti-6AI-4V), usually, strong acids are used, such as $HNO_3$ and HF.

This chemical method is used for stripping organic coatings such as paint, resin, etc. or to remove metal oxides. It makes it possible to treat parts that have complex shapes in acid or solvent baths.

However, being a hot immersion process, it presents dangers linked to the presence of hot acids. The installations are ICPE classified ("installation classee pour la protection de l'environnement" [installation classified for environmental protection]) and require at least one authorization. The acid or solvent baths require fine, daily adjustment. The reprocessing of the baths, in particular those of hydrofluoric acid, constitutes an additional drawback of this process. The installation of a treatment line is specific to each operation: a line for stripping the oxide layer is not compatible with a line for stripping paint on sensitive substrates.

A third known technique is the stripping technique which consists in spraying on the material to be treated a highly pressurized jet of dense supercritical cryogenic nitrogen. The principle of this process resides in the impact at high speed (from 500 to 800 m/s) of the jet resulting from the expansion of the nitrogen initially present under high pressure (up to 3,800 bars) and low temperature (down to −180° C.).

The device necessary for the implementation of this technique comprises a cylindrical mixing chamber provided with an inlet conduit for the particles and an outlet orifice for the jet loaded with particles. The chamber is fit tightly against the inlet opening of a focusing tube or barrel in tungsten carbide. A pipe passes through this focusing tube or barrel, the pipe being divided into two portions: a converging upstream portion having a frustoconical shape, which continues with a downstream portion having a cylindrical shape forming a long cylindrical orifice having a dimension in the order of a millimeter through which the gas escapes to expand in the open air and form the jet that comes to impact the material to be treated.

This technique allows stripping paints, deposits based on polymers, varnishes or grease, oxides, including oxides with strong adhesion to the substrate. It is also used for the preparation of surfaces before depositing paint.

It allows work using the dry method and in a sensitive environment, it does not create additional waste and does not present a danger for the operators or for the environment. The high erosive power of this technique makes it possible to remove deposits having strong metallurgical or chemical adhesion, such as paints or oxides in the substrate. In the same process, it is possible to provide a deburring or cutting step. With the same nitrogen generator and the same robot, it is possible, thanks to specific programs and settings, to treat titanium or its alloys such as TA6V and to strip paint from substrates or from metallic or composite parts. Large surfaces can be treated in this way and it is possible to transport the machine to work sites.

However, the machine has the drawback that the focusing barrel often clogs randomly. This tendency to become blocked or clogged makes the treatment or stripping system inefficient. It also happens that the inlet pipe of the abrasive particles becomes blocked by the formation of ice that results from the reflux in this pipe of a portion of the cryogenic gas, instead of flowing entirely downstream into the focusing barrel. In addition, one must wait several minutes (approximately 5 min) before aspiration of the particles. Indeed, at the beginning of the procedure, the gas jet, which is hot, occupies the volume of the chamber and prevents the formation of the Venturi effect required for aspiration of the particles. It is necessary to wait a certain time (several minutes) before the gas becomes dense or supercritical for the diameter of its jet to becomes thinner and lower in proportion to the diameter of the focusing tube or barrel. This period of time is incompressible, since it corresponds to the cooling of the nitrogen jet in the mixing chamber to form a dense cylindrical stream, the diameter of which is at most equal to the diameter of the cylindrical outlet pipe of the focusing barrel. It often happens that the particles are not aspirated into the mixing chamber even after the gas jet cooling period has elapsed. This is due to insufficient vacuum (Venturi effect) in the mixing chamber. Another drawback resides in the fact that most of the abrasive particles are not aspirated into the core of the nitrogen jet, so that these particles are not sufficiently accelerated by the latter: they mainly remain in a layer of non-dense gas which envelops the dense or supercritical gas jet. This results in a very low effectiveness of the treatment or stripping, with a low impact width of the jet on the surface to be treated or stripped. In fact, the energy of the jet is concentrated at the center of the impact and results in a non-homogeneous treatment or stripping: a first zone of over-treatment or over-stripping with degradation of the substrate material in the axis of the jet and a second peripheral zone of under-treatment or under-stripping, and therefore, of partial treatment or stripping. Finally, the diameter of the free jet of nitrogen loaded with abrasive particles is small (between 1 and 2 mm), it is close to the diameter of the outlet orifice of the focusing barrel. To optimize the stripping zone, it is necessary to increase the firing distance, which can reach between 20 and 200 mm, leading to lateral projection of particles and to pollution of the workstation. Increasing the firing distance can also reduce the energy of the jet and its treating efficiency. This results in poor treatment quality control and low productivity. The other problem with this system using the traditional barrel with a cylindrical outlet pipe resides in the increased energy density of the jet in its center, which results in compressing the material under the jet. This deformation causes significant mechanical stress on the impacted material and induces residual compressive stresses in the upper layer of the treated substrate material. The resulting surface hardening is a problem in certain industrial finishing processes by mechanical machining, for example.

The objective of the present invention is to improve the technique of surface treatment by pressurized jet of liquid nitrogen, supercritical cryogenic nitrogen or hypercritical cryogenic nitrogen that may be loaded with particles, and to avoid the above-mentioned drawbacks.

This objective is achieved by a device according to the preamble in which the focusing barrel is a diffusion focusing barrel constituted by a hollow tube having three successive portions placed one after the other, namely

- a convergent portion located on the side of the inlet opening of the diffusion focusing barrel and whose inner face, considered in the direction of flow of the pressurized jet of liquid nitrogen, supercritical cryogenic nitrogen or hypercritical cryogenic nitrogen, is convergent,
- a neck whose inner face is cylindrical, and
- a divergent portion ending in the outlet opening of the diffusion focusing barrel and whose inner face, considered in the direction of flow of the pressurized jet of liquid nitrogen, supercritical cryogenic nitrogen or hypercritical cryogenic nitrogen, is divergent.

The divergent portion allows rapid expansion of the jet and acceleration of the particles it contains. Thanks to the device of the invention, the speed of the stripping or surface treatment is multiplied by two or more as compared to the method of the state of the art, which reduces cycling time and production cost. In addition, the quality of the stripping or of the treatment is improved. The divergence angle of the divergent portion is adapted as a function of needs so as to more or less increase the imprint or impact width of the jet on the surface to be treated or stripped. Compared to the nitrogen jet coming from a focusing barrel without divergent portion, the width of the imprint or impact of the jet on the surface to be treated or stripped can be multiplied by three or more for the removal of hard layers or layers chemically diffused in the substrate, such as alpha-case in titanium alloy TA6V, or by five or more for the removal of oxide layers not diffused in the substrate, including iron oxide (corrosion). Furthermore, the problems of blocking and clogging of the jet, as they are known with the devices of the state of the art, are eliminated. The mechanical device is interchangeable and can easily be mounted on current machines that use pressurized supercritical cryogenic nitrogen jet. Thus, with this device, it is possible to control the force applied to the surface and, depending on the desired needs, to modulate the energy of the impact of the jet on the material to be treated in order to modify or not its mechanical surface properties. To this effect, the speed and/or size of the jet and the mechanical properties of the particles can be adapted. The jet has a homogeneous structure on its impact surface. For example, compression of the impacted material can be considerably reduced, which induces little or no deformation of the impacted surface, and the residual compressive stresses on the surface layer of the treated substrate material are very low or even nil. This result is interesting because the surface hardening is controlled and the finishing operations by machining are facilitated. On the contrary, it is also possible, for example, to carry out hammering of the surface to be treated by choosing particles of large diameter and/or a high jet speed.

The divergence angle of the inner face of the divergent portion is defined between the tangent to the surface and the axis of revolution of the diffusion focusing barrel. It can be constant over the entire length of the barrel. It can also vary. In this case, the further away from the neck, the more the divergence angle decreases and the effect of divergence is weak. The divergence is reduced to prepare the jet to leave the diffusion focusing barrel while forming a conical jet close to a cylinder. This can be done continuously or gradually.

Therefore, there are two distinct cases:

- either the divergence of the inner face of the divergent portion is continuous between the neck and the outlet opening of the diffusion focusing barrel,
- or the divergence of the inner face of the divergent portion is discontinuous between the neck and the outlet opening of the diffusion focusing barrel.

In the first case, the divergence of the inner face of the divergent portion can be constant between the neck and the outlet opening of the diffusion focusing barrel so that the inner face of the divergent portion has a frustoconical shape. The conical geometry of the inner face is inscribed in a cylinder forming over its entire length the outer face of the diffusion focusing barrel.

The divergence can be continuous without being constant. The inner face of the divergent portion may for example be parabolic so that when leaving the neck, the divergence is maximum and gradually decreases to reach its minimum value at the outlet of the barrel.

In the discontinuous solution, the inner face of the divergent portion can be divided into at least two successive sections each having a frustoconical shape, the cone angle of each section, formed between the generatrix of the cone and the axis of revolution, decreasing more and more from one section to the other between the first section adjacent to the neck and the last section adjacent to the outlet of the diffusion focusing barrel. In a simple embodiment, there are two sections. The sections do not necessarily have the same length.

To facilitate the manufacture of the diffusion focusing barrel, it is possible to divide the diffusion focusing barrel into two separate parts which can be assembled together. The first part comprises for example the convergent portion, the neck and the upstream portion of the divergent portion while the second part comprises the downstream portion of the divergent portion.

The divergence of the upstream portion located in the first part is preferably greater than or equal to the divergence of the downstream portion located in the second part. Here too, the inner face of each portion can be frustoconical or have a non-constant divergence.

According to the invention, it is preferable that the mixing chamber is constituted by a tubular wall, preferably cylindrical or elliptical, closed on one side by an upstream wall provided with an inlet orifice of the jet and on the other side by the downstream wall provided with the outlet orifice of the jet, the inlet orifice of the jet, the outlet orifice of the jet, the convergent portion, the neck and the divergent portion of the barrel being aligned on a common axis passing through the mixing chamber. Such a mixing chamber, with all the characteristics that follow, can be used both with a diffusion focusing barrel according to the invention and with a conventional focusing barrel.

In a preferred embodiment of the invention, the greatest width of the mixing chamber perpendicular to the axis is preferably greater than or equal to the height of the mixing chamber parallel to the axis. When the mixing chamber is cylindrical, the large width corresponds to the diameter of the cylinder. When the mixing chamber is elliptical, it corresponds to the major axis of the ellipse. In some applications, the height of the chamber may be greater than its great width. The axis is preferably offset relative to the center of the tubular wall. This configuration makes it possible to create a vacuum in an extreme environment with the presence of gas in a duplex form: a dense or supercritical cryogenic jet and a stream of expanded gas at the periphery of the dense jet. The mixing chamber is similar to a gas and particle jet injection ring. The geometric shape of the injection ring makes it possible to manage the complex dual state of compression/expansion caused by the rapid expansion of the nitrogen jet, at the outlet of the nozzle, in the volume of the mixing chamber.

When the device of the invention is to be used with pressurized liquid nitrogen, supercritical cryogenic nitrogen or hypercritical cryogenic nitrogen loaded with particles, a supply conduit for the particles can pass through the tubular wall and open into the mixing chamber through a particle inlet orifice. In order to move the inlet of the particle stream away from the pressurized jet of liquid nitrogen, supercritical cryogenic nitrogen or hypercritical cryogenic nitrogen, it is preferable that the distance between the particle inlet orifice and the axis is greater than the distance between the axis and the portion of the tubular wall opposite to the particle inlet orifice. To prevent the particles from colliding perpendicularly with the pressurized jet of liquid nitrogen, supercritical cryogenic nitrogen or hypercritical cryogenic nitrogen, it is preferable that the particle supply conduit is inclined towards the downstream portion of the mixing chamber.

In a development of the invention, an inlet conduit of the jet passes through the upstream wall and opens into the mixing chamber through the inlet orifice of the jet, the inlet conduit of the jet being aligned with the axis of the jet. The upstream end of the inlet conduit of the jet is provided with a nozzle through which an orifice having a cross-section smaller than the cross-section of the inlet conduit of the jet passes. The upstream surface of the nozzle is preferably planar and perpendicular to the axis of the jet. The nozzle is arranged at the junction between a conduit, called collimation tube, which is generally part of the generator of pressurized liquid nitrogen, supercritical cryogenic nitrogen or hypercritical cryogenic nitrogen, and the inlet conduit of the jet, in such a way that the upper face of the nozzle forms a flat bottom relative to the wall of the collimation tube. Assembly of the nozzle with the focusing tube is carried out with a cross-section change at right angles. The pressurized liquid nitrogen, supercritical cryogenic nitrogen, or hypercritical cryogenic nitrogen must pass through the collimating tube, pass through the nozzle orifice, and expand in the mixing chamber, before being refocused in the diffusion focusing barrel. It should be noted that the nozzle with its upstream surface planar and perpendicular to the axis of the jet can also be used in conventional devices, with or without a mixing chamber according to the invention, with or without a diffusion focusing barrel of the invention.

The invention also relates to the focusing barrel for a device for the surface treatment of a material by a pressurized jet of liquid nitrogen, supercritical cryogenic nitrogen or hypercritical cryogenic nitrogen that may be loaded with particles, said barrel having an inlet opening and an outlet opening. According to the invention, the focusing barrel is a diffusion focusing barrel constituted by a hollow tube having three successive portions placed one after the other, namely:

- a convergent portion located on the side of the inlet opening of the diffusion focusing barrel and whose inner face, considered in the direction of flow of the pressurized jet of liquid nitrogen, supercritical cryogenic nitrogen or hypercritical cryogenic nitrogen, is convergent,
- a neck whose inner face is cylindrical, and
- a divergent portion ending in the outlet opening of the diffusion focusing barrel and whose inner face, considered in the direction of flow of the pressurized jet of liquid nitrogen, supercritical cryogenic nitrogen or hypercritical cryogenic nitrogen, is divergent.

This diffusion focusing barrel can be used with a mixing chamber. However, it can also be used directly on the collimation tube of a generator of pressurized liquid nitrogen, supercritical cryogenic nitrogen or hypercritical cryogenic nitrogen if the jet is not loaded with particles. In this case, it is preferable to place a nozzle in the trajectory of the jet, for example at the interface between the collimation tube and the diffusion focusing barrel. Depending on needs, the inlet opening of the barrel can be designed to be fastened to a mixing chamber so as to be in fluid contact with the outlet orifice of the mixing chamber or to be fastened to the collimator tube of the generator of pressurized liquid nitrogen, supercritical cryogenic nitrogen or hypercritical cryogenic nitrogen so as to be in fluid contact with the outlet orifice of said collimation tube.

As indicated above, the divergence of the inner face of the divergent portion can be continuous or discontinuous between the neck and the outlet opening of the diffusion focusing barrel.

The divergence of the inner face of the divergent portion can be constant between the neck and the outlet opening of the diffusion focusing barrel so that the inner face of the divergent portion has a frustoconical shape. The divergence can be continuous without being constant.

In the discontinuous solution, the inner face of the divergent portion can be divided into at least two successive sections each having a frustoconical shape, the cone angle of each section, formed between the generatrix of the cone and the axis of revolution, decreasing more and more from one section to the other between the first section adjacent to the neck and the last section adjacent to the outlet of the diffusion focusing barrel.

It is possible to divide the diffusion focusing barrel into two separate parts which can be assembled together. The first part comprises for example the convergent portion, the neck and the upstream portion of the divergent portion while the second part comprises the downstream portion of the divergent portion. The divergence of the upstream portion located in the first part is preferably greater than or equal to the divergence of the downstream portion located in the second part. Here too, the inner face of each portion can be frustoconical or have a non-constant divergence.

The objective of the invention is also achieved by a method for the surface treatment of a material by a pressurized jet of liquid nitrogen, supercritical cryogenic nitrogen or hypercritical cryogenic nitrogen which may be loaded with particles. According to the invention, the method provides for the following steps consisting of

- introducing a pressurized jet of liquid nitrogen, supercritical cryogenic nitrogen or hypercritical cryogenic nitrogen into a mixing chamber,
- causing the pressurized jet of liquid nitrogen, supercritical cryogenic nitrogen or hypercritical cryogenic nitrogen to leave the mixing chamber by passing through a conduit having a convergent cross-section, then in a conduit having a constant cross-section, and then in a conduit having a divergent cross-section. These various conduits, assembled in this order, form the diffusion focusing barrel.

It should be noted that if the pressurized jet of liquid nitrogen, supercritical cryogenic nitrogen or hypercritical cryogenic nitrogen does not need to be loaded with particles, the focusing diffusion method of the invention can be used directly, without necessarily going through a mixing chamber, in particular by focusing diffusing a pressurized jet of liquid nitrogen, supercritical cryogenic nitrogen or hypercritical cryogenic nitrogen coming directly from a generator of pressurized liquid nitrogen, supercritical cryogenic nitrogen or hypercritical cryogenic nitrogen. The jet can be passed through a nozzle before being passed through the convergent section conduit.

The liquid nitrogen, supercritical cryogenic nitrogen or hypercritical cryogenic nitrogen, possibly loaded with particles in the mixing chamber, is focused and compressed in the convergent portion of the barrel, then it passes through the cylindrical neck in which it is homogenized and stabilized, before being expanded quickly and in a controlled manner in the divergent portion, whose downstream end constitutes the application tool.

Particles can be introduced into the mixing chamber so that they mix with at least a portion of the pressurized jet of liquid nitrogen, supercritical cryogenic nitrogen, or hypercritical cryogenic nitrogen in the mixing chamber, forming a gas jet/particles mixture. The particles are preferably aspirated into the mixing chamber by a Venturi effect created by the passage of the pressurized jet of liquid nitrogen, supercritical cryogenic nitrogen or hypercritical cryogenic nitrogen in the mixing chamber. They can also be introduced by propulsion. The pressurized jet of liquid nitrogen, supercritical cryogenic nitrogen or hypercritical cryogenic nitrogen can be injected into the mixing chamber by passing through a nozzle of a calibrated orifice.

Depending on the intended applications, the particles can have a spherical or non-spherical shape; and/or the particles can be nano-structured; and/or the particles can be based on glass, ceramic, metal, polymer, wood, biological materials, or composite; and/or the particles can be made of a single material or of at least two different materials; and/or the particles can have a hybrid form, in particular an envelope of a material totally or partially coating a core made of another material.

The method of the invention can be used for stripping metallic or ceramic oxides, in particular those having strong adhesion to the substrate, whether they are diffused in the substrate, such as alpha-case in titanium alloy TA6V or alumina $Al_2O_3$ in aluminum, or not diffused. It can also be used for the treatment or preparation of surfaces before machining or before depositing functional layers, such as metallic or non-metallic coatings, or paints or polymers, or for stripping coatings, in particular paints, polymer-based deposits, varnish or grease. It can also be used for modifying the structure of the surface by imprinting a texturing, for creating a roughness or a particular surface topography, or even for peening surfaces, in particular hammering and work hardening. The method can also be used for creating a surface layer on a substrate, in particular by embedding particles on the substrate. It is in particular possible, by introducing metallic particles (such as copper, silver, aluminum, iron or alloys, particles, for example steel particles) or non-metallic particles (such as polymer, wood or glass particles, or even biological particles such as antibiotics or pharmaceuticals) in the pressurized jet of liquid nitrogen, supercritical cryogenic nitrogen or hypercritical cryogenic nitrogen, to mechanically embed these particles in a metallic or non-metallic substrate (for example made of polymeric material, elastomeric material, wood or textile material). In this way, particles can be embedded in a substrate without distortion of the treated surface, and with uniform distribution of the deposit without overconcentration in some areas.

A particularly interesting application of this embedding is the metallization of polymer, polymer-matrix composites, elastomers, wood or textile substrates, which gives them an electrical, thermal, electromagnetic wave conductivity and/or a metallic appearance. The layer of particles thus created can also serve as a base for a future deposition, for example by cold spray or another method of depositing metallic materials.

Another interesting application is the deposition of antibacterial particles on wood or textile materials, conferring antibacterial properties to these substrates.

Figure 1A:
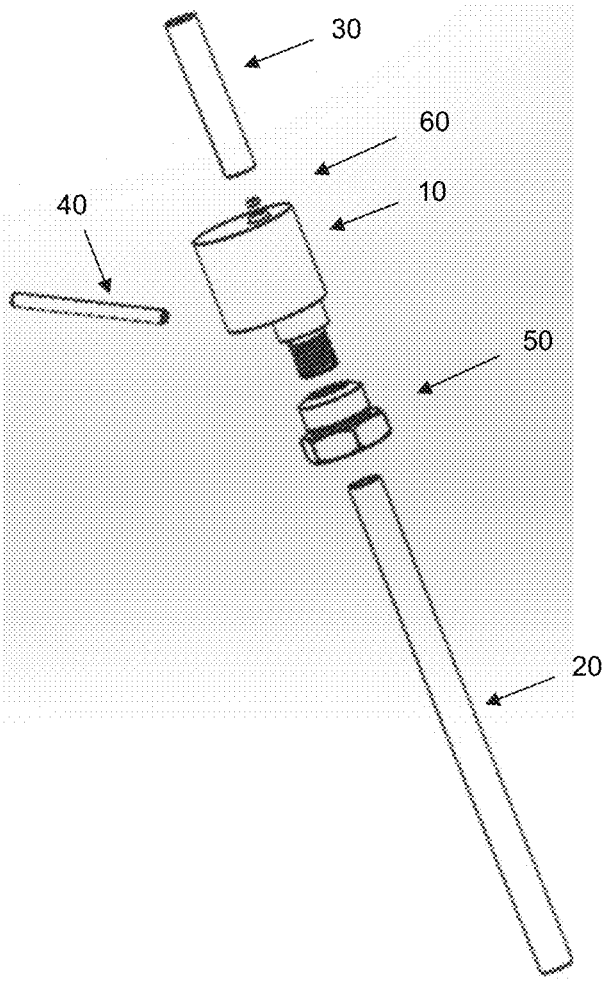
Figure 2A:
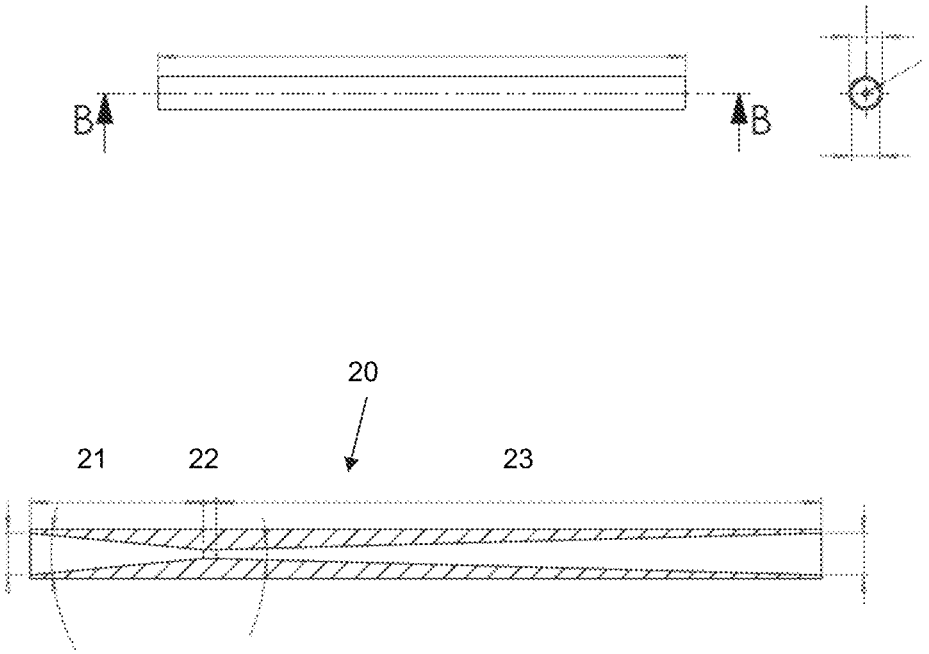

Examples of embodiments of the invention are described below, with reference to the drawings which show schematically:

FIG. 1*a*: an exploded view of the device of the invention,

FIG. 1*b*: a cross-section of the device of the invention with the barrel of FIG. 2*a*.

Figure 2B:
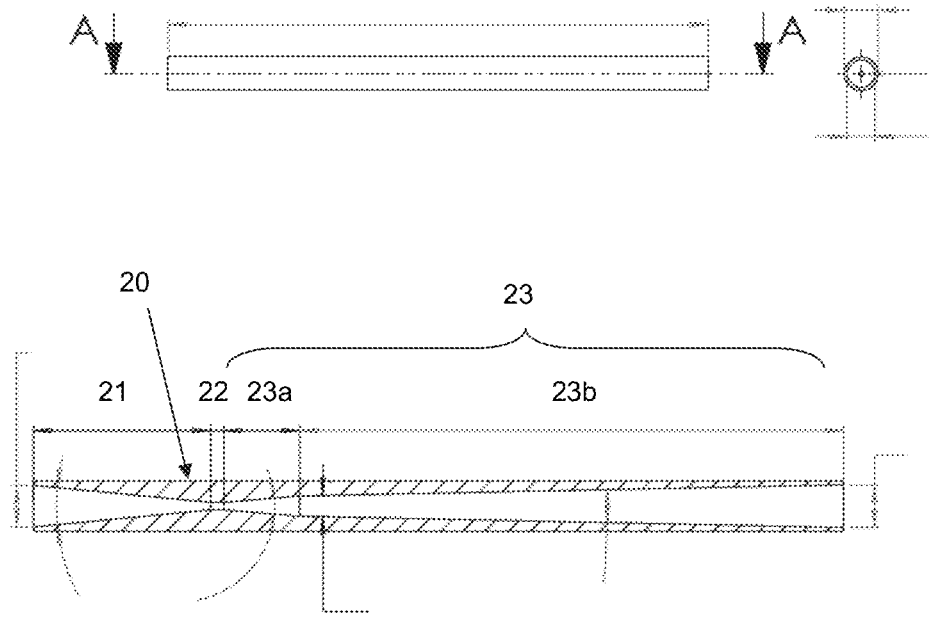
Figure 2C:
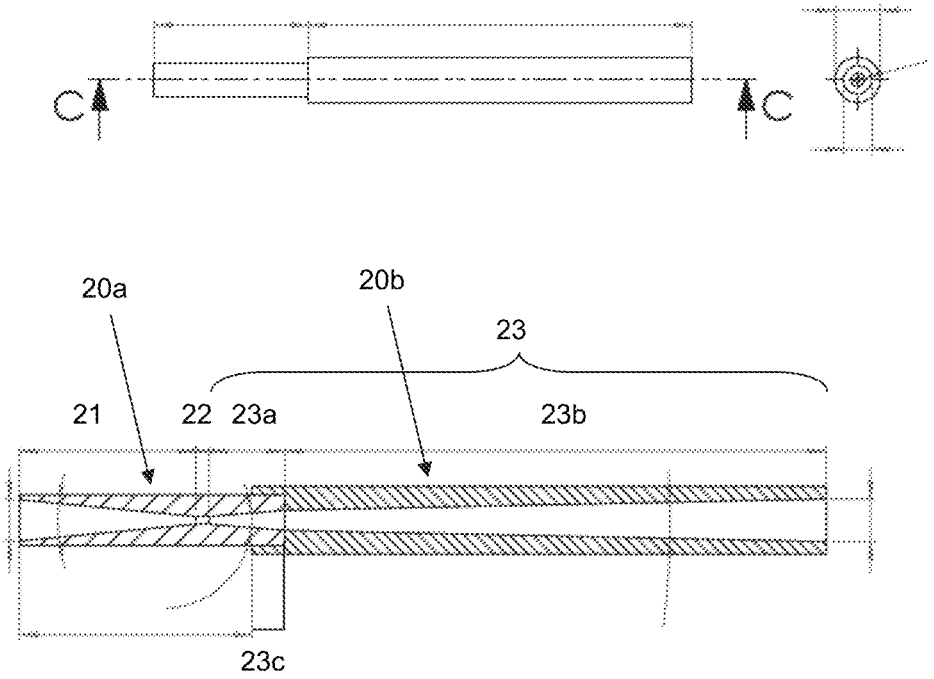
Figure 3A:
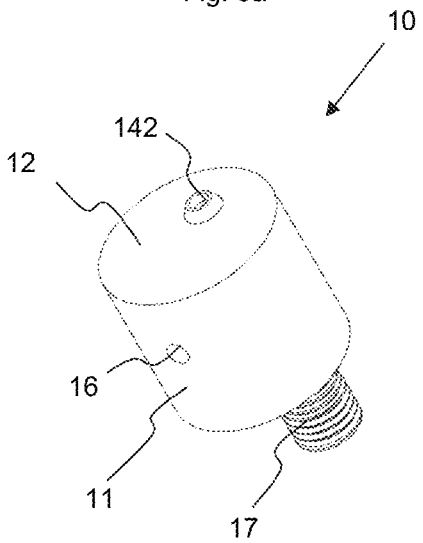
Figure 3C:
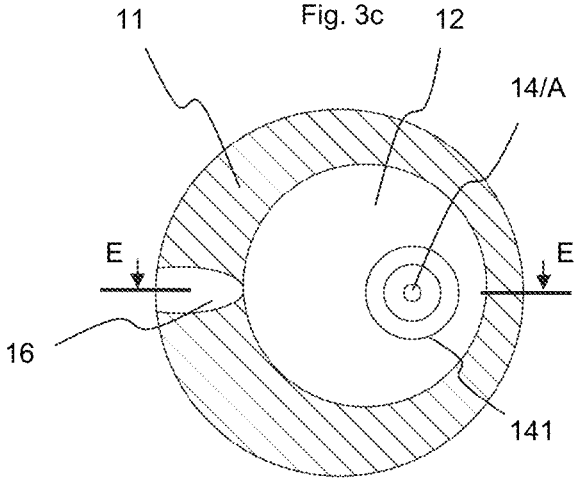
Figure 3B:
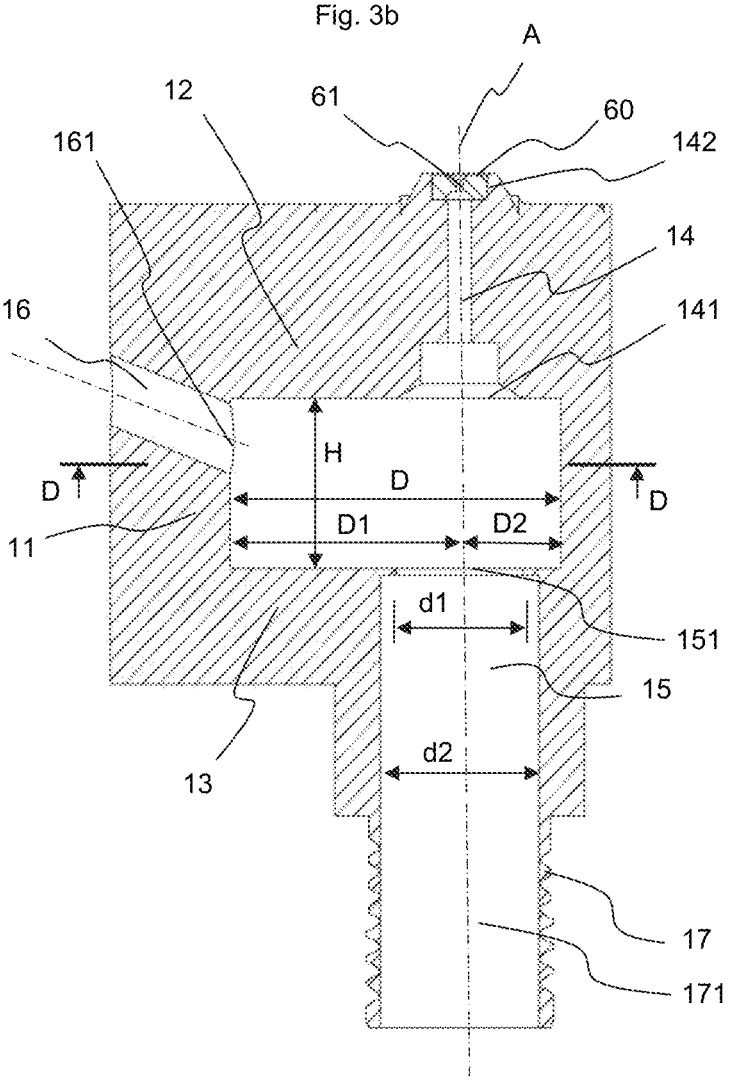

FIG. 2*a*: a cross-section of a monobloc diffusion focusing barrel having a continuous divergent inner face, FIG. 2*b*: a cross-section of a monobloc diffusion focusing barrel having a two-stage discontinuous divergent inner face, FIG. 2*c*: a cross-section of a multi-block diffusion focusing barrel with a two-stage discontinuous divergent inner face, FIG. 3*a*: a perspective view of a mixing chamber according to the invention, FIG. 3*b*: the mixing chamber of FIG. 3*a*, seen in longitudinal cross-section according to cross-section line EE of FIG. 3*c*, FIG. 3*c*: the mixing chamber of FIG. 3*a*, seen in cross-section according to cross-section line DD of FIG. 3*b*.

The invention relates to a device and a method for the surface treatment of a material by a pressurized jet of liquid nitrogen, supercritical cryogenic nitrogen or hypercritical cryogenic nitrogen. Depending on the desired applications, the pressurized jet of liquid nitrogen, supercritical cryogenic nitrogen or hypercritical cryogenic nitrogen can be loaded with particles. The following description is given on the example of using a jet of liquid nitrogen, supercritical cryogenic nitrogen or hypercritical cryogenic nitrogen loaded with particles. This example has no limiting effect.

The device shown in FIGS. 1*a* and 1*b* is essentially composed of the following parts:

a mixing chamber (10), a diffusion focusing barrel (20), a nozzle (60), a tightening nut (50) making it possible to fasten the diffusion focusing barrel to the mixing chamber.

The mixing chamber (10) is connected to a generator of pressurized liquid nitrogen, supercritical cryogenic nitrogen or hypercritical cryogenic nitrogen via a collimation tube (30). When the device is used with pressurized liquid nitrogen, supercritical cryogenic nitrogen or hypercritical cryogenic nitrogen loaded with particles, a particle supply tube (40) is connected to the mixing chamber (10).

The nitrogen jet passes through the device by passing successively through the collimation tube (30), the nozzle (60), the mixing chamber (10) and the diffusion focusing barrel (20). By convention, the term "upstream" is used for the portions of these parts through which the nitrogen jet enters said part, and the term "downstream" for the portions through which the nitrogen jet leaves the part.

FIGS. 3*a*, 3*b* and 3*c* show the mixing chamber (10) having a tubular shape. In the example presented here, this chamber is cylindrical. It is constituted by a tubular wall (11) whose inner axial face is cylindrical. The tubular wall is closed at its upstream and downstream ends by an upstream wall (12) and a downstream wall (13), respectively, which are preferably radial.

An inlet conduit (14) of the jet passes right through the upstream wall (12). The inlet conduit (14) of the jet opens into the mixing chamber by a chamber inlet orifice (141). The collimation tube (30) is sealingly fastened perpendicularly to the upper planar surface of the nozzle (60) received in a housing (142) provided at the outer end of the inlet conduit (14) of the jet.

An outlet conduit (15) of the jet passes right through the downstream wall (13). It opens into the mixing chamber by a chamber outlet orifice (151) having a diameter (d1) which is less than the diameter (d2) of the outlet conduit (15) of the jet. The outlet conduit (15) of the jet serves as a guide and as housing for the diffusion focusing barrel (20).

An fastening end-piece (17) protrudes from the outer face of the downstream wall (13) towards the outside of the chamber, a coaxial conduit (171) having the same diameter as the outlet conduit (15) of the jet passing through the fastening end-piece: the two conduits (15, 171) are in alignment and in continuity with one another. The fastening end-piece (17) serves to fasten the diffusion focusing barrel (20) to the mixing chamber (10) via the tightening nut (50). Thus, the outlet conduit (15) of the jet and the conduit (171) of the fastening end-piece (17) together form a barrel-holding conduit (15, 171). The outer face of the upstream end of the diffusion focusing barrel (20) penetrates into the conduits (15, 171) and abuts against the wall surrounding the outlet opening (151).

The inlet conduit (14) of the jet and the outlet conduit (15) of the jet are preferably cylindrical. They are aligned, as are the chamber inlet orifice (141) and chamber outlet (151) orifice, the collimation tube (30) and the conduit (171) of the fastening end-piece (17), on a same axis (A) which passes through the mixing chamber. The axis (A) corresponds to the path of the jet of liquid nitrogen, supercritical cryogenic nitrogen or hypercritical cryogenic nitrogen. The axial inner face of the tubular wall (11) is preferably parallel to the axis (A).

A particle supply conduit (16) passes right through the cylindrical wall (11), the particle supply conduit (16) serving to introduce the solid particles into the nitrogen jet. The particle supply conduit (16) is preferably inclined, relative to the plane perpendicular to the axis (A), towards the downstream portion of the mixing chamber. The abrasive particles are aspirated into the mixing chamber, for example, by Venturi effect due to the circulation of nitrogen passing through the mixing chamber (10), which causes a stream of air to enter the chamber through the conduit (16). The particles can also be pushed inside the mixing chamber by an air injection system.

The nozzle (60) is placed at the inlet (142) of the inlet conduit (14) of the jet. It is pierced by a calibrated orifice (61). It is arranged at the junction between the collimation tube (30) and the inlet conduit (14) of the jet. Its upstream face is planar and perpendicular to the axis (A) of the collimation tube (30), in such a way that this upstream face of the nozzle and the downstream end of the collimation tube form a flat bottom. The mixing chamber is screwed tight against the collimation tube (30).

The mixing chamber (10), which plays the role of an injection ring, has a particular geometry designed to make it possible to create a sufficient vacuum in an extreme environment, with the presence of expanded peripheral gas surrounding the jet of dense liquid nitrogen, supercritical cryogenic nitrogen or hypercritical cryogenic nitrogen leaving the nozzle (60). The geometric shape of the mixing chamber (10) must be capable of optimally managing the complex dual state formed in the inner volume of the mixing chamber by, on the one hand, the expanded peripheral gas, and on the other hand, the dense pressurized gas jet. This mixing chamber (10) is characterized by its diameter (D) and its height (H). The diameter is measured perpendicular to axis (A) while the height is measured parallel to axis (A). The supply conduit (16) of the particles opens into the mixing chamber at a location where the cylindrical wall (11) is furthest from the axis (A), namely at a distance (D1). At the location where the cylindrical wall (11) is closest to the axis (A), in this case opposite to the supply conduit (16) of the particles, it is at a distance (D2) of axis (A). The diameter (D) is therefore equal to the sum of these two distances (D1, D2). The diameter (D) is preferably equal to or greater than the height (H), but the diameter (D) can also be less than the height (H) in some cases. The chamber is also characterized by the diameter (d1) of its outlet opening (151).

Thanks to the off-center position of the axis (A) of the nitrogen jet, spaced away from the inlet orifice (161) of the particle supply conduit (16), the disruptive effect on the nitrogen jet and on its alignment with the axis (A), caused by the stream of particles associated with the air entering laterally into the chamber, is considerably reduced. Indeed, thanks to this off-center positioning of the axis (A), the speed of the flow of particles and air is suitably slowed down, which allows the particles and the incoming air to penetrate first into the outer layer of expanded nitrogen (mixing envelope) surrounding the dense supersonic supercritical jet in the mixing chamber through which it passes. Thus, formation of a complex mixture takes place, composed of the particles, the peripheral expanded gas and the supercritical gas jet. The mixture obtained under the conditions of the invention follows a gradual process towards the axis of the downstream jet while maintaining the thermomechanical properties of the jet. This effect is amplified, because it is promoted by the inclination of the particle supply conduit (16) towards the downstream portion of the jet and of the mixing chamber, the particles coming into contact with the nitrogen jet at an oriented incidence angle which converges towards the downstream portion of the chamber. The offset position of the axis (A) of the jet relative to the inlet orifice of the particles (161) also avoids the problem of ice formation in the supply line of the particles.

The orifice (61) of the nozzle (60) serves to accelerate the pressurized jet of liquid nitrogen, supercritical cryogenic nitrogen or hypercritical cryogenic nitrogen before it enters the mixing chamber. Generally, the upstream faces of the nozzles of the state of the art are conical, narrowing in the direction of flow of the gas and ending with the orifice. On the contrary, in the invention, the upstream face of the nozzle forms a planar surface perpendicular to the axis (A) of the gas jet. In addition, it is placed as close as possible to the cylindrical inner wall of the collimation tube (30). Ideally, the upstream surface of the nozzle should be in direct extension of the cylindrical portion of the collimation tube. In practice, it may be necessary, to obtain a good seal, to have the contact surface between the collimation tube and the mixing chamber be conical so that the upstream face of the nozzle, while being as close as possible to the cylindrical downstream portion of the collimation tube, is not completely in contact with it. A better result in terms of particle aspiration and energy has been observed with such a jet, which is better controlled and exhibits less disturbance.

The diffusion focusing barrel (20) is designed to play two roles: on the one hand, guaranteeing the mechanical balance in the mixing chamber (10) by creating a constant and sufficient vacuum within it, and on the other hand, forming a nitrogen jet loaded with particles having a homogeneously distributed energy density at the outlet of the diffusion focusing barrel (20). To this effect, the barrel (20) is constituted by a hollow tube having, placed one after the other in the direction of flow of the nitrogen jet, three successive portions, namely, a convergent portion (21), a neck (22) and a divergent portion (23). In the convergent portion, the jet of gas and particles is focused and partially re-compressed. The envelope of expanded nitrogen, with the particles it contains and which surround the supercritical jet, is compressed and directed towards the neck. The jet then passes through the neck (22) having a cylindrical shape, in which the particles enter the core of the pressurized jet of liquid nitrogen, supercritical cryogenic nitrogen or hypercritical cryogenic nitrogen in order to obtain an optimal gas/particle mixture and improve the transfer of momentum from the gas jet to the downstream particles, which makes it possible to accelerate the particles efficiently. The jet thus homogenized and stabilized is then rapidly expanded in a controlled manner in the divergent diffusion portion (23) having a particular volume and a particular shape that make it possible to obtain maximal acceleration of the particles and their distribution in a homogeneous and ideal manner within the jet. This configuration ideally leads to maximizing the thermomechanical energy of the gas jet loaded with particles and to distributing it homogeneously over the impact zone, so as to obtain an improved efficiency of material removal, including hard materials diffused in the substrate, among which are oxides of the type alpha-case $TiO_2$ diffused in titanium and its alloys TA6V, and alumina $Al_2O_3$ diffused in aluminum and its alloys. The jet coming out of the diffusion focusing barrel is very slightly conical. Its expansion, instead of taking place at the outlet of the barrel as is the case with the barrels of the state of the art, takes place gradually and in a controlled manner in the divergent portion. This also results in a larger imprint of the jet and in a better control of its geometry (width, depth) upon impact on the surface of the material to be treated.

FIG. 2 show three exemplary embodiments of the diffusion focusing barrel.

The convergent portion (21) is located in the upstream section of the diffusion focusing barrel. Considered in the direction of gas flow, its inner face is convergent. This convergent portion makes it possible to properly direct the dense gas as well as the peripheral gas and the particles which surround the supercritical jet towards the neck (22), and thus to promote the vacuum in the mixing chamber (10). It also makes it possible to focus the jet. The convergent portion (21) preferably has a frustoconical shape.

The convergent portion (21) is continued by a neck (22) whose inner face is cylindrical. This neck serves to stabilize the nitrogen jet, to promote the penetration of the particles into the nitrogen jet, and to homogenize the kinetic energy density of the two-phase jet of gas loaded with particles. It makes it possible to obtain an optimal gas/particle mixture and to promote the transfer of momentum from the gas jet to the downstream particles, which in turn makes it possible to accelerate the particles efficiently. The diameter and length of the neck are critical parameters: on the one hand, the diameter of the neck (22) acts directly on the vacuum obtained in the mixing chamber (10) and thus determines the mechanical balance of the gas, particles, nitrogen jet mixture, and on the other hand, the length of the neck (22) acts both on the physics of the jet and on its thermomechanical energy at the inlet of the divergent portion of the barrel.

The cylindrical neck (22) is continued by the divergent portion (23) located in the downstream section of the diffusion focusing barrel. Considered in the direction of gas flow, its inner face is divergent. It is the end portion of the diffusion focusing barrel. It defines and determines the physical envelope of the diffusion of the jet and it accompanies the expansion of the jet so as to obtain a maximal energy density distributed homogeneously in the radial direction. Thus, the gas jet loaded with particles has a circular geometry of maximal diameter and homogeneous thermomechanical energy density. In the examples shown in FIGS. 2*a* to 2*c*, the inner face of the divergent portion has a frustoconical shape.

As shown in FIG. 2*a*, the diameter of the divergent portion (23) can decrease continuously and constantly, thus giving this divergent portion a frustoconical shape. It would be possible to have a continuous but variable divergent portion, for example by giving the inner face of the divergent portion a parabolic shape. By way of non-limiting example, such a diffusion focusing barrel can have the following dimensions:

Total length: 160 mm
Length of the convergent portion (21): 35 mm
Length of the neck (22): 2.6 mm
Length of the divergent portion (23): 122.4 mm
Convergence angle of the convergent portion (21): 5.465°
Divergence angle of the divergent portion (23): 1.57°
Diameter of the neck (22): 1.80 mm
Diameter of the inlet and outlet of the barrel: 8.50 mm
Outer diameter of the barrel: 10 mm However, it is also possible to divide the divergent portion (23) into at least two successive sections of decreasing divergence (23*a*, 23*b*). Here too, the divergence of each section can be constant, i.e., the inner face of the section is frustoconical, or variable. In the example presented here, the cone angle defined between the generatrix of the cone and the axis of revolution decreases more and more from one section to another between the first section (23*a*) located just after the neck (22) and the last section (23*b*) located on the side of the downstream outlet of the barrel. In the example shown in FIGS. 2*b* and 2*c*, the divergent portion is divided into two frustoconical sections (23*a*, 23*b*). The sections do not necessarily have the same length.

In the example of FIG. 2*c*, the diffusion focusing barrel (20) is constituted by two distinct parts (20*a*, 20*b*) assembled together, preferably so as to be able to be separated. The first part (20*a*) has the convergent portion (21), the neck (22) and the upstream portion (23*a*) of the divergent portion (23). The second part (20*b*) is fastened to the first (20*a*), for example, by fitting, via an fastening section (23*c*) which surrounds at least the free end of the upstream portion (23*a*). The diameter of the downstream end of the upstream portion (23*a*) is identical to the upstream diameter of the downstream portion (23*b*). The taper of the downstream portion (23*b*) can be identical to that of the upstream portion (23*a*), but it is preferably less, so as to form a barrel similar to that of the example of FIG. 2*b*. This two-part solution (20*a*, 20*b*) has the advantage of facilitating the manufacture of the diffusion focusing barrel and of making it possible to adapt the taper according to the needs of each application.

The diffusion focusing barrel can also be used with a pressurized jet of liquid nitrogen, supercritical cryogenic nitrogen or hypercritical cryogenic nitrogen without the addition of particles. In this case, the mixing chamber does not need to have a particle supply conduit. It is also not necessary that the axis (A) of the jet is off-center relative to the tubular chamber (11). Another solution consists in completely dispensing with the mixing chamber (10) and in fastening the diffusion focusing barrel (20) directly at the outlet of the collimation tube (30), preferably with the interposition of a nozzle (60).

In the exemplary embodiment presented here, the mixing chamber (10) has a cylindrical shape. It would be possible, in order to avoid dead spaces, to give its transverse cross-section (perpendicular to the axis (A) of the jet) a more elongated shape, for example an elliptical shape, or a rectangular shape with the small sides rounded. The particles which are not aspirated in the jet fall back onto the tubular wall (11) of the chamber and risk accumulating. By choosing an elongated shape for the transverse cross-section, the particles are forced to return, either towards the jet (if they accumulate in portion D2), or towards the stream of aspirated particles (if they accumulate in portion D1). In the case of an elongated tubular chamber, the supply conduit of the particles opens into one of the two ends of the elongated shape and the axis (A) of the jet is offset towards the other elongated end.

If the pressurized liquid nitrogen, supercritical cryogenic nitrogen or hypercritical cryogenic nitrogen is loaded with particles, it is possible to use particles having a spherical or non-spherical shape or nanostructured particles, and the particles may be based on glass, ceramic, metal, polymer or composite. The particles can be made of a single material or of at least two different materials. Without being limiting, the particles can have a hybrid form, for example an envelope of a material totally or partially coating a core made of another material.

The mixing chamber (10) is preferably made of stainless steel, for example 316L stainless steel. The diffusion focusing barrel (20) is preferably made of carbide, in particular of tungsten carbide. The nozzle (60) is generally made of diamond, of sapphire, of tungsten carbide.

The nozzle (60) could be placed in the collimation tube (30), preferably at its downstream end, rather than in the inlet conduit of the liquid nitrogen, supercritical cryogenic nitrogen or hypercritical cryogenic nitrogen (14).

As has been said previously, the diameter and the length of the neck (22) are important parameters. They are chosen according to the type of application and the desired energy of the jet. The diameter of the neck (22) also takes into account, where appropriate, the size of the particles used. Depending on needs, the size of the particles may vary from 1 to 1,000 μm for stripping or for creating surface roughness or topography, or for texturing, or even up to 3 mm or more for hammering or work hardening. For stripping or for creating surface texturing or roughness, the diameter of the neck can be chosen between 1 and 3 mm with or without particles. For a hammering or work hardening application, the neck diameter must be larger (up to 5 mm or more). These values are given by way of example and have no limiting value. The length of the neck has an effect on the speed of the particles, and therefore on the kinetic energy of the jet. Up to a certain length, the longer the neck, the better the energy. For example, lengths between 2 and 50 mm have given good results. In the case of a particularly long neck, the version of the barrel in two parts (see FIG. 2*c*) is to be preferred. In this case, the first part (20*a*) can have only the convergent portion (21) and the neck (22), while the second part (20*b*) can have the entire divergent portion (23).

The device of the invention, and in particular the mixing chamber, can be used vertically as in FIG. 3*b*, horizontally, or more generally in any spatial orientation.

Thanks to the device of the invention, the speed of stripping or surface treatment is multiplied by a factor greater than two, and the treated surface is homogeneous and larger as compared to the process of the state of the art, which reduces cycling time and production cost. The performance of the method makes it possible to remove layers of materials from the softer to the hardest, including layers of oxides chemically diffused in substrates such as alpha-case of titanium and its alloys, or alumina.

LIST OF REFERENCES

1 Device
- 10 Mixing chamber
- 11 Tubular wall, preferably cylindrical or elliptical
- 12 Upstream wall
- 13 Downstream wall
- 14 Inlet conduit of the pressurized liquid nitrogen, supercritical cryogenic nitrogen or hypercritical cryogenic nitrogen

141 Inlet orifice of the pressurized liquid nitrogen, supercritical cryogenic nitrogen or hypercritical cryogenic nitrogen into the mixing chamber

142 Housing of the nozzle at the inlet of the conduit of pressurized liquid nitrogen, supercritical cryogenic nitrogen or hypercritical cryogenic nitrogen

15 Outlet conduit of the pressurized liquid nitrogen, supercritical cryogenic nitrogen or hypercritical cryogenic nitrogen

151 Outlet orifice of the pressurized liquid nitrogen, cryogenic supercritical nitrogen or cryogenic hypercritical nitrogen out of the mixing chamber

16 Supply conduit of the particles

161 Inlet orifice of the particles into the mixing chamber

17 Barrel-holding end-piece

171 Conduit of the barrel-holding end-piece

D Width (inner diameter when the chamber is cylindrical) of the mixing chamber

D1 Distance between the inlet orifice of the particles and the axis of the pressurized jet of liquid nitrogen, supercritical cryogenic nitrogen or hypercritical cryogenic nitrogen (off-centering of the aspiration on the side of the inlet of the particles)

D2 Distance from the axis of the jet to the tubular wall opposite to the inlet orifice of the particles H Internal height of the mixing chamber d1 Diameter of the outlet orifice of the mixing chamber d2 Diameter of the barrel-holding conduit A Axis of the pressurized jet of liquid nitrogen, supercritical cryogenic nitrogen or hypercritical cryogenic nitrogen

20 Diffusion focusing barrel

20*a* First part of the diffusion focusing barrel

20*b* Second part of the diffusion focusing barrel

21 Convergent portion

22 Neck

23 Divergent portion

23*a* Upstream section

23*b* Downstream section

23*c* Fastening end-piece of the second part

30 Collimation tube

31 Downstream end

40 Particle supply tube

50 Tightening nut

60 Nozzle

61 Injection orifice

The invention claimed is:

1. Method for the surface treatment of a material by a pressurized jet of liquid nitrogen, supercritical cryogenic nitrogen or hypercritical cryogenic nitrogen loaded with particles, including:

introducing a pressurized jet of liquid nitrogen, supercritical cryogenic nitrogen or hypercritical cryogenic nitrogen into a mixing chamber, so as to form an expanded outer layer of gaseous nitrogen surrounding a dense central jet of liquid nitrogen, supercritical cryogenic nitrogen or hypercritical cryogenic nitrogen, introducing particles into the mixing chamber so that they mix into the expanded outer layer of gaseous nitrogen, causing the pressurized jet of liquid nitrogen, supercritical cryogenic nitrogen or hypercritical cryogenic nitrogen to leave the mixing chamber by passing through a diffusion focusing barrel comprising, successively, a conduit having a convergent section, then a conduit having a constant section, and then a conduit having a divergent section, wherein in the diffusion focusing barrel, the particles are mixed progressively into the central jet of the pressurized jet, so that an energy density of the particles is homogeneously distributed throughout the pressurized jet at an outlet of the divergent section of the diffusion focusing barrel.

2. The method according to claim 1, wherein the pressurized jet is a pressurized jet of supercritical cryogenic or hypercritical cryogenic nitrogen.

3. The method according to claim 1, wherein the particles have at least one of the following features:

the particles have a spherical shape, the particles are nano-structured, the particles are based on glass, ceramic, metal, polymer, wood or biological materials, or composite, the particles are made of a single material, the particles have a hybrid form, including an envelope of a material totally or partially coating a core made of another material.

4. The method according to claim 1, including at least one of:

stripping metallic or ceramic oxides, stripping coatings, preparing surfaces before machining or before depositing functional layers, surface texturing, creating roughness or topographic surface impression, peening surfaces, in particular hammering and work hardening, creating a surface layer on a substrate.

5. The method according to claim 1, wherein the particles are aspirated into the mixing chamber by a Venturi effect created by the passage of the pressurized jet of liquid nitrogen, supercritical cryogenic nitrogen or hypercritical cryogenic nitrogen in the mixing chamber or are introduced by propulsion.

6. The method according to claim 1, wherein the pressurized jet of liquid nitrogen, supercritical cryogenic nitrogen or hypercritical cryogenic nitrogen is injected into the mixing chamber by passing through a nozzle having a calibrated orifice.

7. The method according to claim 1, wherein the inlet opening of the barrel is designed to be fastened to the mixing chamber while being in fluid contact with the outlet orifice of the mixing chamber.

8. The method according to claim 1, wherein a divergence of an inner face of the divergent portion is continuous between the neck and the outlet opening of the diffusion focusing barrel.

9. The method according to claim 1, wherein a divergence of the inner face of the divergent portion is discontinuous between the neck and the outlet opening of the diffusion focusing barrel.

10. The method according to claim 9, wherein the inner face of the divergent portion is divided into at least two successive sections each having a frustoconical shape, the cone angle of each section, formed between the generatrix of the cone and the axis of revolution, decreasing more and more from one section to the other between a first section adjacent to the neck and a last section adjacent to the outlet of the diffusion focusing barrel.

11. The method according to claim 1, wherein the diffusion focusing barrel comprises two separate parts which can be assembled together, the first part comprising the convergent portion, the neck and an upstream portion of the divergent portion, and the second part comprising a downstream portion of the divergent portion.

12. The method according to claim 1, wherein the mixing chamber comprises a tubular wall, closed on one side by an upstream wall provided with an inlet orifice of the jet and on the other side by the downstream wall provided with an outlet orifice of the jet, the inlet orifice, the outlet orifice, the convergent portion, the neck and the divergent portion of the barrel being aligned on a common axis passing through the mixing chamber, a greatest width perpendicular to the axis of the mixing chamber being greater than or equal to a height parallel to the axis of the mixing chamber.

13. The method according to claim 1, wherein the mixing chamber comprises a tubular wall, closed on one side by an upstream wall provided with a jet inlet orifice and on another side by a downstream wall provided with a jet outlet orifice, the jet inlet orifice, the jet outlet orifice, the convergent portion, the neck and the divergent portion of the barrel being aligned on a common axis passing through the mixing chamber, a greatest width perpendicular to the common axis of the mixing chamber being less than a height parallel to the common axis of the mixing chamber.

14. The method according to claim 12, wherein a particle supply conduit passes through the tubular wall and opens into the mixing chamber by a particle inlet orifice, a first distance between the particle inlet orifice and the common axis being greater than a distance between the common axis and a portion of the tubular wall opposite to the particle inlet orifice.

15. The method according to claim 12, wherein a jet inlet conduit passes through the upstream wall and opens into the mixing chamber by the jet inlet orifice, the jet inlet conduit being aligned with the common axis, the upstream end of the jet inlet conduit being provided with a nozzle including an orifice, the orifice having a cross-section smaller than a cross-section of the jet inlet conduit, an upstream surface of the nozzle being planar and perpendicular to the common axis.

16. The method according to claim 8, wherein the divergence of the inner face of the divergent portion is constant between the neck and the outlet opening of the diffusion focusing barrel so that the inner face of the divergent portion has a frustoconical shape.

17. The method according to claim 11, wherein the divergence of the upstream portion located in the first part is greater than or equal to the divergence of the downstream portion located in the second part.

18. The method according to claim 17, wherein an inner face of the upstream portion and an inner face of the downstream portion each have a frustoconical shape.

19. The method according to claim 12, wherein the common axis is offset relative to a center of the tubular wall.

20. The method according to claim 13, wherein the common axis is offset relative to a center of the tubular wall.

21. The method according to claim 14, wherein the particle supply conduit is inclined towards the downstream portion of the mixing chamber.

* * * * *